US008359870B2

(12) United States Patent
Thatcher et al.

(10) Patent No.: US 8,359,870 B2
(45) Date of Patent: Jan. 29, 2013

(54) AUTOMATIC FUEL NOZZLE FLAME-HOLDING QUENCH

(75) Inventors: Robert Thomas Thatcher, Greer, SC (US); Joel Meador Hall, Mauldin, SC (US); Andrew Mitchell Rodwell, Greenville, SC (US)

(73) Assignee: General Electric Company, Schenectady, NY (US)

( * ) Notice: Subject to any disclaimer, the term of this patent is extended or adjusted under 35 U.S.C. 154(b) by 920 days.

(21) Appl. No.: 12/464,401

(22) Filed: May 12, 2009

(65) Prior Publication Data

US 2010/0287937 A1 Nov. 18, 2010

(51) Int. Cl.
*F02C 3/30* (2006.01)
*F02C 7/00* (2006.01)
*F02G 3/00* (2006.01)

(52) U.S. Cl. ..... 60/775; 60/779; 60/39.3; 60/39.55; 60/39.091

(58) Field of Classification Search ..... 60/775, 60/779, 39.24, 39.26, 39.3, 39.55, 39.091, 60/39.11, 737, 746, 747, 748; 431/163, 363
See application file for complete search history.

(56) References Cited

U.S. PATENT DOCUMENTS

| | | | | |
|---|---|---|---|---|
| 4,104,869 | A * | 8/1978 | Vincent | 60/39.55 |
| 4,160,362 | A * | 7/1979 | Martens et al. | 60/39.182 |
| 5,148,667 | A * | 9/1992 | Morey | 60/779 |
| 5,676,712 | A * | 10/1997 | Anderson | 48/192 |
| 6,003,296 | A * | 12/1999 | Citeno et al. | 60/772 |
| 6,357,216 | B1 * | 3/2002 | Scott et al. | 60/779 |
| 6,679,060 | B2 * | 1/2004 | Hellat et al. | 60/775 |
| 7,216,486 | B2 * | 5/2007 | Doebbeling et al. | 60/773 |
| 7,435,080 | B2 | 10/2008 | Joklik et al. | |
| 2007/0006596 | A1 * | 1/2007 | Fujii | 60/779 |
| 2010/0077720 | A1 * | 4/2010 | Poyyapakkam et al. | 60/39.53 |
| 2010/0146984 | A1 * | 6/2010 | Carroni et al. | 60/775 |

* cited by examiner

*Primary Examiner* — Ehud Gartenberg
*Assistant Examiner* — Michael B Mantyla
(74) *Attorney, Agent, or Firm* — Cantor Colburn LLP

(57) ABSTRACT

A flame-holding control method in a gas turbine having a combustor can and a fuel nozzle disposed in the combustor can. The method can include performing a first scheduled injection of a diluent stream into the nozzle, checking to see if a time period has exceeded a time threshold and in response to the time period being greater than that the time threshold, performing a second scheduled injection of the diluent stream into the nozzle.

20 Claims, 5 Drawing Sheets

AUTOMATIC FUEL NOZZLE FLAME-HOLDING QUENCH

BACKGROUND OF THE INVENTION

The subject matter disclosed herein relates to flame-holding in gas turbine combustors, and more particularly to an automatic fuel nozzle flame-holding quench system and method.

Due to infrequent release in energy or an anomalous control action causing a flashback, it is possible for a flame to be sustained inside a gas turbine combustor fuel nozzle. Once initiated inside the nozzle, the flame can hold in an unintended location and cause damage and liberation of the fuel nozzle potentially resulting in significant damage to the gas turbine.

BRIEF DESCRIPTION OF THE INVENTION

According to one aspect of the invention, a flame-holding control method in a gas turbine having a combustor can and a fuel nozzle disposed in the combustor can, is provided. The method can include performing a first scheduled injection of a diluent stream into the nozzle, setting a time threshold based on durability of the fuel nozzle subject to a flame-holding event and checking to see if a time period has exceeded the time threshold. The method can further include in response to the time period being greater than the time threshold, performing a second scheduled injection of the diluent stream into the nozzle.

According to another aspect of the invention, a gas turbine system is provided. The system can include a compressor configured to compress air and a combustor can in flow communication with the compressor, combustor can being configured to receive compressed air from the compressor and to combust a fuel stream. The system can further include a fuel nozzle disposed in the combustor can and configured to receive a scheduled injection of a diluent stream and a triggered injection of the diluent stream to the fuel nozzle. The system can further include a timer configured to generate timed periods after which the scheduled injection is performed.

According to yet another aspect of the invention, a flame-holding control system is provided. The system can include a gas turbine combustor can and a fuel nozzle disposed in the combustor can and configured to receive compressed air and a fuel stream to generate a flame, and further configured to receive a periodic diluent stream to prevent a flame-holding event and a triggered diluent stream to inhibit combustion in response to a detection of a flame-holding event. The system can further include a timer configured to generate timed periods after which the scheduled injection is performed.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
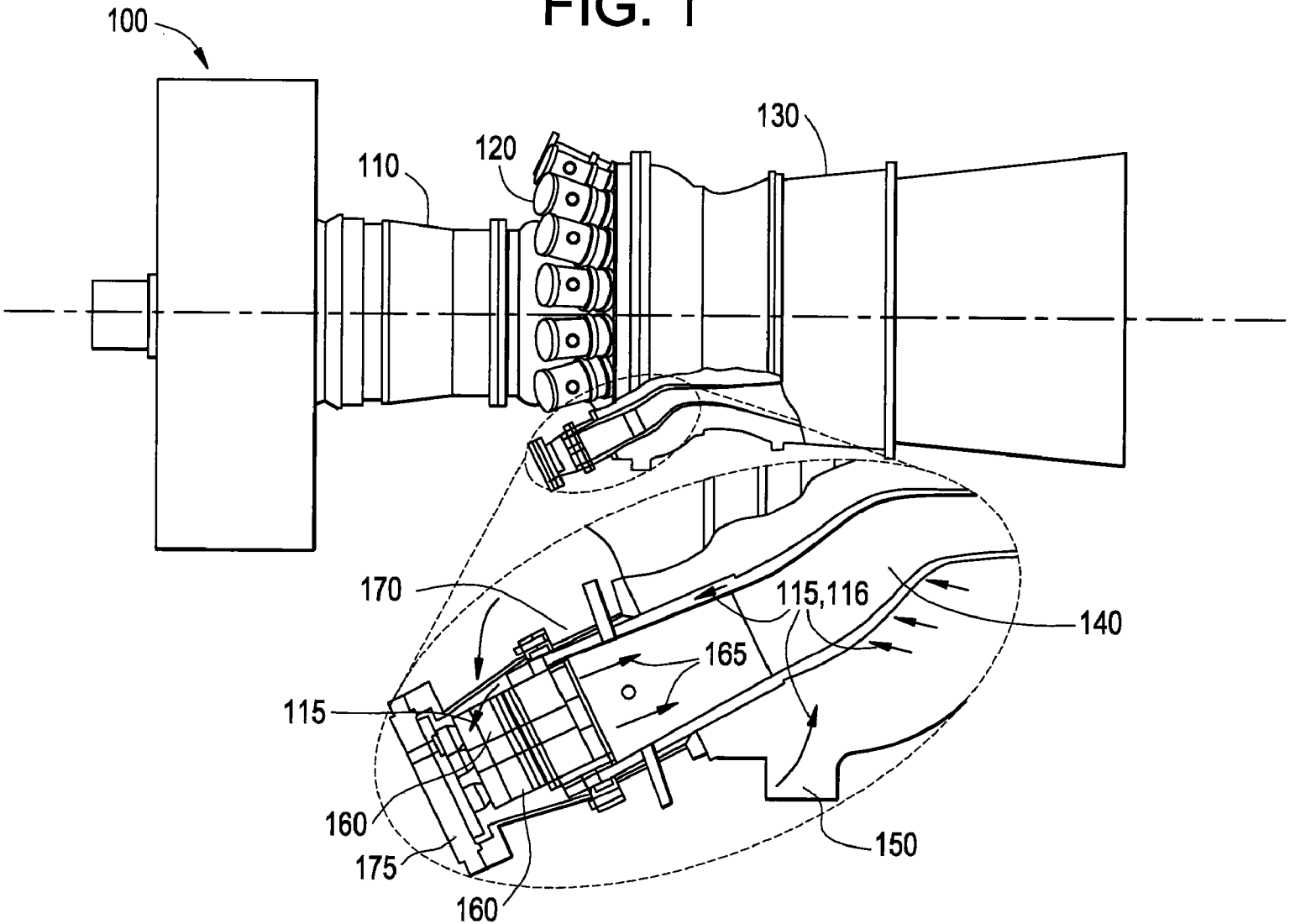
FIG. 1 diagrammatically illustrates a side view of a gas turbine system in which exemplary automatic fuel nozzle flame-holding quench system can be implemented.

FIG. 1 diagrammatically illustrates a side view of a gas turbine system 100 in which exemplary automatic fuel nozzle flame-holding quench system can be implemented. In exemplary embodiments, the gas turbine 100 includes a compressor 110 configured to compress ambient air. One or more combustor cans 120 are in flow communication with the compressor 110 via a diffuser 150. The combustor cans 120 are configured to receive compressed air 115 from the compressor 110 and to combust a fuel stream from fuel nozzles 160 to generate a combustor exit gas stream 165 that travels through a combustion chamber 140 to a turbine 130. The turbine 130 is configured to expand the combustor exit gas stream 165 to drive an external load. The diffuser 150 can further provide a diluent stream 116 from some external location to the gas turbine system 100. For example, the diluent may be steam from an external boiler. The diluent may also be some inert gas such as nitrogen left over from gasification processes external to the gas turbine system 100. It is to be appreciated that several different diluents are contemplated. The combustor cans 120 each include an external housing 170 and an end cap 175 onto which the nozzles 160 are disposed. Fuel is supplied to the combustor cans 120 via the nozzles 160. The nozzles 160 can receive different fuel types (e.g., both a high BTU fuel such as natural gas to start combustion and a low BTU fuel such as syngas to maintain combustion). In exemplary embodiments, the system 100 can provide automated control to initiate a quenching pulse of steam (or like diluent) on a periodic basis to arrest the flame-holding event before significant damage occurs. In exemplary embodiments, a quenching pulse could be automatically initiated upon the detection of a flame-holding event as described herein. This brief quench decreases the performance impact to the powerplant operator when compared to requiring a constant supply of diluent flow as currently performed.

Figure 2:
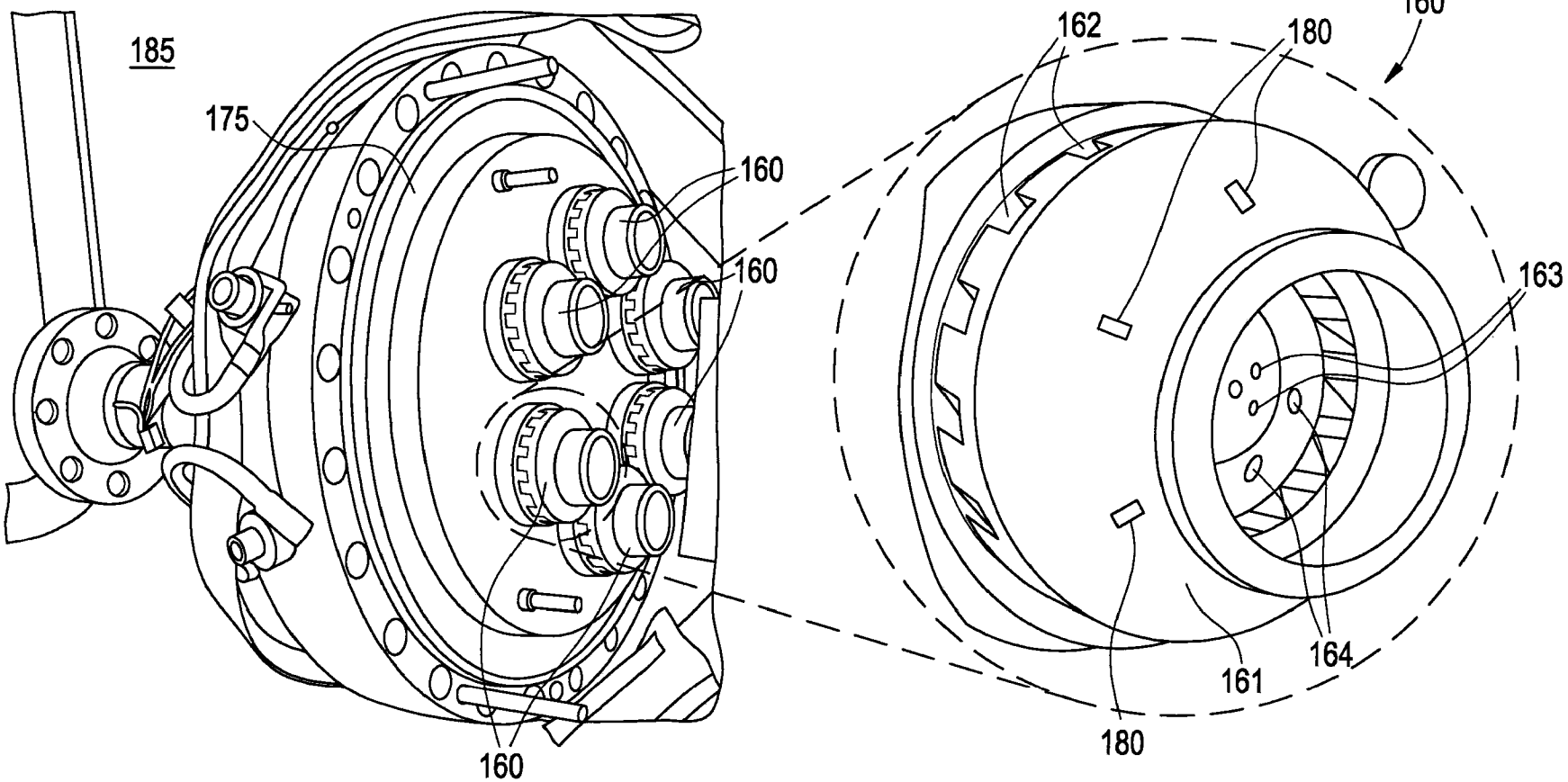
FIG. 2 illustrates a side perspective view of a combustor can end cap having fuel nozzles disposed thereon.

FIG. 2 illustrates a side perspective view of a combustor can end cap 175 having fuel nozzles 160 disposed thereon. One of the nozzles 160 is shown in an expanded view. Each nozzle 160 can include a nozzle housing 161 having air apertures 162 configured to receive air 115 from the compressor 110 as discussed above. The air apertures 162 are also configured to receive the diluent stream 116 as further described herein. The nozzles 160 can further include first (e.g., high BTU) fuel apertures 163 and second (e.g., low BTU) apertures 164 configured to receive fuel streams for combustion as described herein. Both the compressed air 115 and the diluent stream 116 flow into the nozzle housing 161 adjacent the high first fuel apertures 163 and the second fuel apertures 164. It is appreciated that the compressed air 115 is provided to mix with the fuel flows for combustion. The diluent stream 116 is provided to control and dilute combustion should there be flame-holding within the nozzle 160. Under desired conditions, there is premixing of the air stream 115 and the fuel streams from the first and second fuel apertures 163, 164 within the nozzle housing 161 resulting in combustion outside the nozzle housing. If there is flame-holding, that is, combustion, within the nozzle housing 161, the diluent stream 116 is implemented to quench or dilute the flame within the nozzle housing 161. Currently, a quenching stream is provided constantly in order to prevent flame-holding within the nozzle housing. However, it is to be appreciated that such a constant flow of the diluent stream can inhibit performance of the nozzles 160. For example, desirable combustion can be inhibited in the constant presence of the diluent stream 116. In exemplary embodiments, the systems and methods described herein can provide a periodic diluent stream to the nozzle housing 161 via the air apertures to quench flame-holding, if present. It is to be appreciated that the periodic quenching diluent stream can ensure that there is no flame-holding within the nozzle housing 161 without having to provide a constant diluent stream, which as discussed above, inhibits performance. In exemplary embodiments, the nozzles 160 can further include a series of detectors 180 such as thermocouples that detect heat changes in the nozzle housing 161. In this way, instead of providing a constant diluent stream or even a periodic diluent stream, the detectors 180 can be implemented to detect a rise in heat within the nozzle housing, the rise in heat being indicative of flame-holding. Once this rise is heat is detected, a quenching diluent stream can then be provided. In exemplary embodiments, a periodic diluent stream can be provided in addition to implementation of the detectors 180 to provide a quenching diluent stream when actual flame-holding is detected. In this way, both a periodic stream and a triggered stream (i.e., when the detectors sense a rise in heat) can be provided.

Currently, continuous injections of diluent are provided to ensure that no flame-holding events occur and to reduce emissions. In exemplary embodiments, existing hardware can be implemented to provide scheduled and triggered injections of diluent to both prevent flame-holding events and to address flame-holding events when they occur. In addition, a timer 185 operatively coupled to the nozzles 160 can be configured for comparison to a time threshold after which the scheduled injection is performed. As such, the timer 185 is configured to generate timed periods after which the scheduled injection is performed.

Figure 3:
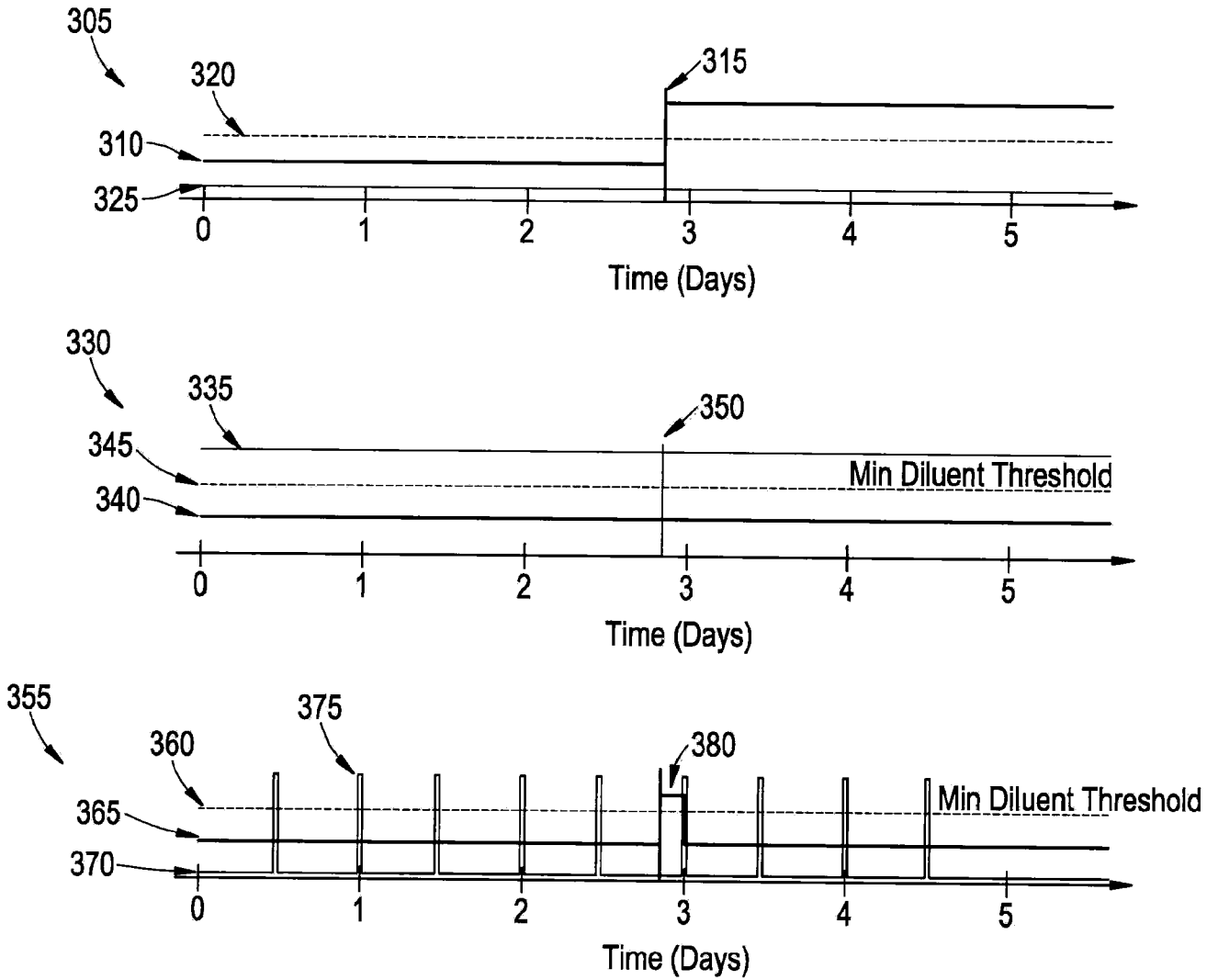
FIG. 3 illustrates plots of diluent flow and nozzle temperature versus time.

FIG. 3 illustrates plots of diluent flow and nozzle temperature versus time. A first plot 305 illustrates that a nozzle temperature, represented by line 310, can increase when a flame-holding event 315 occurs. A minimum diluent threshold, represented by line 320, in theory, can be provided to quench any flame-holding event. However, if the actual diluent stream flow, represented by line 325, is too low, there is no quenching of the flame-holding event. With little or no diluent present, a flame can stabilize inside the fuel nozzle due to an anomalous event, which can lead to durability issues and damage the nozzle.

Plot 330 illustrates a current strategy in which the actual diluent flow, represented by line 335 is kept well above the nozzle temperature, as represented by line 340, and the minimum diluent threshold, represented by line 345. In this way, any flame-holding event 350 is immediately quenched. As such, with sufficient diluent present, the flame cannot stabilize inside the nozzle.

In exemplary embodiments, plot 355 illustrates that the minimum diluent threshold, represented as line 360 as discussed above, the nozzle temperature, represented by line 365 and an actual diluent flow, represented by line 370. The plot 355 shows that periodic pulses 375 in the diluent stream can be provided. In this way, when an event 380 occurs, it is quenched by the next pulse 375. The plot shows that the event can last for a period of time before the pulse occurs. For this reason, the periodicity is selected as a time well within the tolerance range of the nozzles. It is appreciated that the nozzles can withstand a flame-holding event with no detriment. For example, the periodicity of the pulses 375 shown is a half day. This period is selected because the nozzles can tolerate a flame-holding event for longer than half a day. As such, automated pulses ensure flame quenching prior to raising any durability issue of the nozzles. In conjunction with the implementation of the detectors 180, the flame-holding event can be quenched immediately removing the concern regarding the tolerance of the nozzles. In the plots 305, 330, 355 described above, the time has been illustrated as days. It is appreciated that other periods are contemplated in exemplary embodiments.

Figure 4:
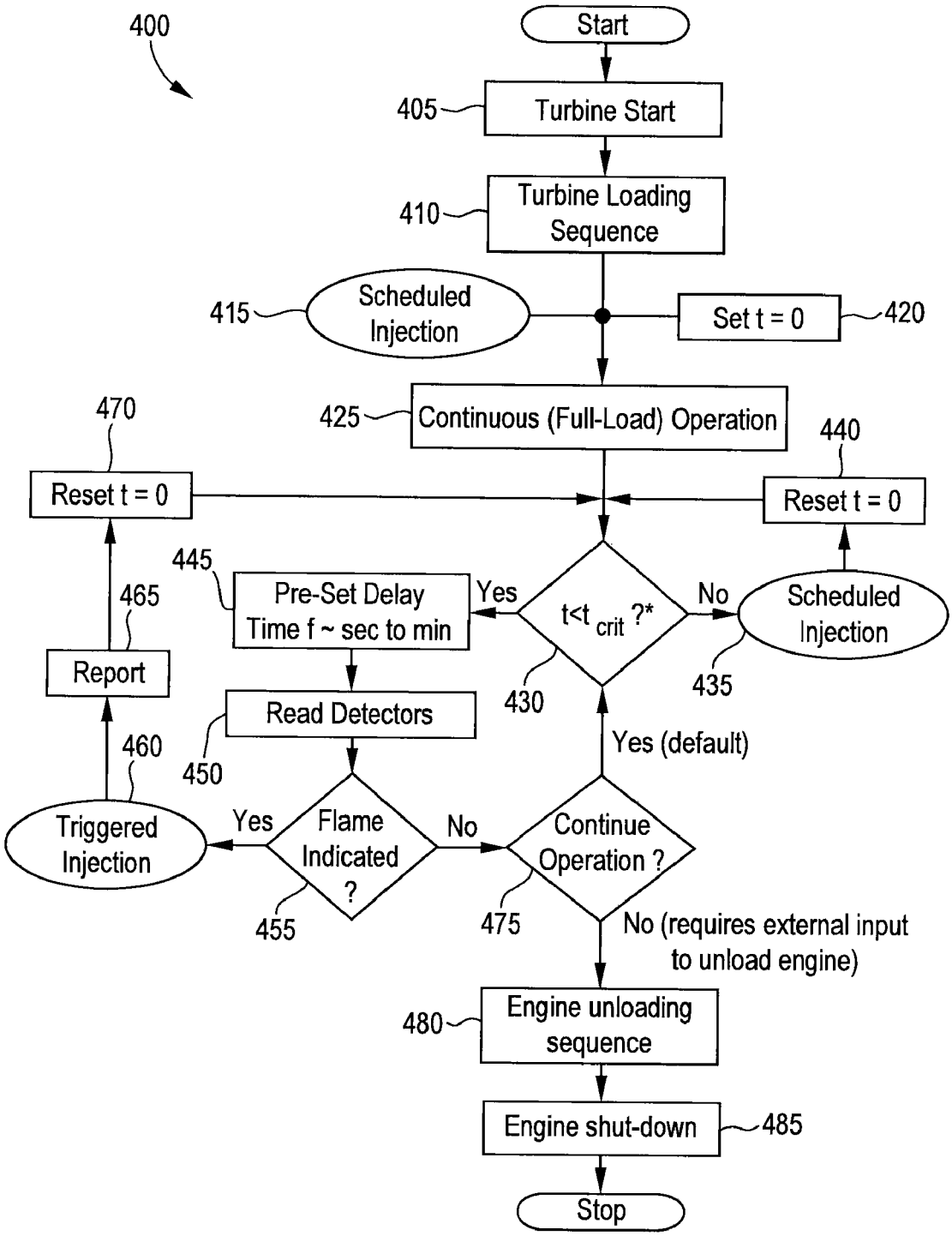
FIG. 4 illustrates a flow chart of a method for diluent injections in accordance with exemplary embodiments.

FIG. 4 illustrates a flow chart of a method 400 for diluent injections in accordance with exemplary embodiments. The method 400 includes a combination of both schedules and triggered diluent injections. As discussed above, it is to be appreciated that either of the scheduled and triggered injections can be implemented in exemplary embodiments. At block 405, the system 100 starts the turbine 130. At block 410, the turbine 130 goes through a loading sequence. At block 415, a scheduled injection of diluent into the nozzles 160 is performed. At the same time, at block 420, the time is reset to 0. At block 425, the turbine 130 goes through continuous operation. At block 430, the system 100 determines if the time has surpassed a critical time $t_{crit}$. In exemplary embodiments $t_{crit}$ is a pre-set limit for hardware durability, to protect against sensor failure. If t is not less than $t_{crit}$ at block 430, then a scheduled injection is made at block 435 and t is reset to 0 at block 440. If t is less than $t_{crit}$ at block 430, then at block 445, the system 100 presets the delay time from seconds to minutes (from a first time to a second time) to delay the periodicity of the scheduled injections. At block 450, the detectors 180 are read to determine if any flame-holding event has occurred. At block 455, the system 100 determines if a flame has been detected in the nozzles 160. If at block 455, a flame is detected, then at block 460 a triggered diluent stream is injected into the nozzles 160. At block 465, the system 100 can generate a report to alert the turbine operators that flame-holding has occurred in the nozzles. At block 470 t is reset back to 0 and the process repeats at block 430. If at block 455, no flame was detected, it is determined whether operation of the turbine 130 is to continue at block 475. If at block 475, operation is to continue, then the process repeats at block 430. If at block 475, operation is not to continue, then at block 480 the system 100 goes through a turbine unloading sequence. At block 485, the turbine is shut down.

Figure 5:
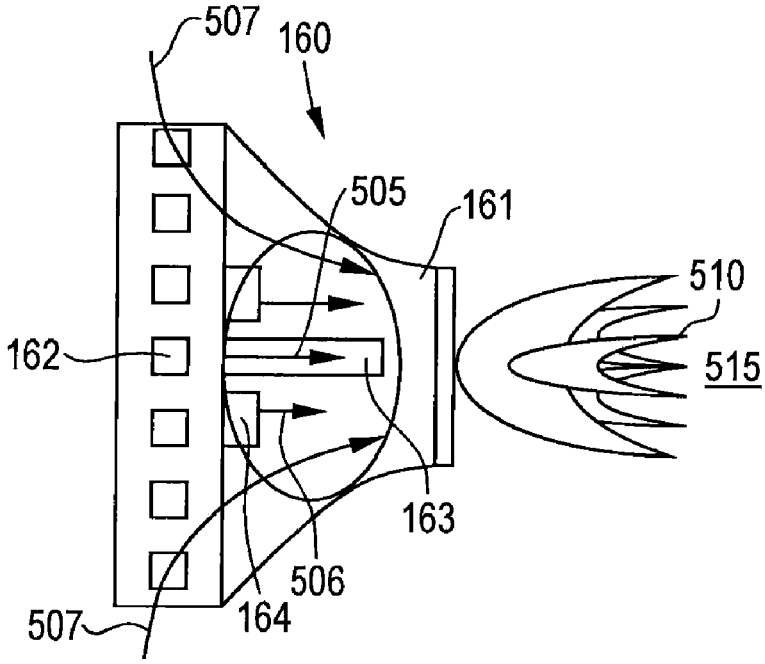
FIG. 5 diagrammatically illustrates a nozzle operating with a flame under desired combustion conditions.

FIG. 5 diagrammatically illustrates a nozzle 160 operating with a flame under desired combustion conditions. A first (e.g., high BTU) fuel stream 505 flows through the first fuel apertures 163. Similarly, a second (e.g., low BTU) fuel stream 506 flows through the second apertures 164. An air stream 507 flows through the air apertures 162 into the nozzle housing 601. Premixing of the fuel streams 505, 506 occurs in the nozzle housing 161 and combustion results in a flame 510 outside the nozzle housing 161 in the combustion chamber 515.

Figure 6:
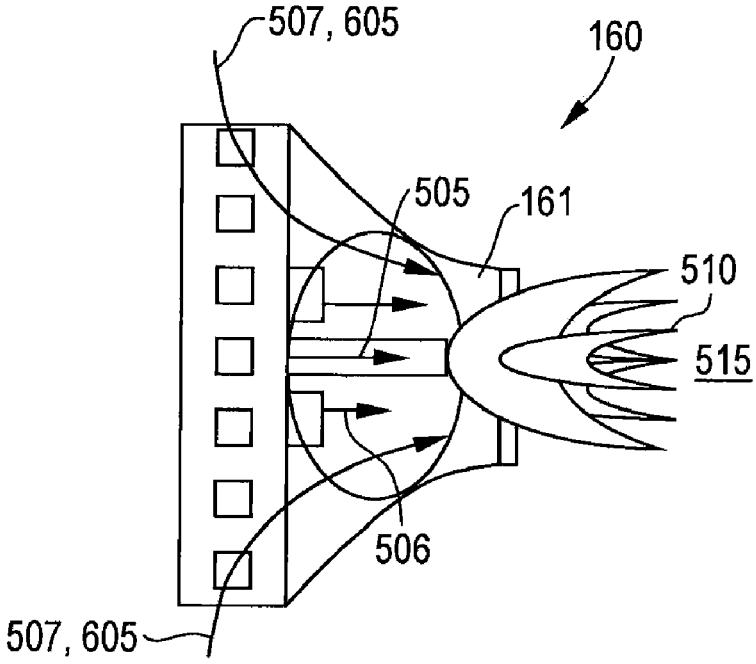
FIG. 6 diagrammatically illustrates the nozzle of FIG. 5 operating in a flame-holding condition.

FIG. 6 diagrammatically illustrates the nozzle 160 of FIG. 5 operating in a flame-holding condition. Under this condition, the flame 510 now burns inside the nozzle housing 161. The fuel streams 595, 506 can continue. In exemplary embodiments, the air stream 507 of FIG. 5 can either be mixed with or temporarily replaced with a diluent stream 605 as described above. Once either the scheduled or triggered injection of the diluent stream 605 is complete, the nozzle 160 returns to desired operation as shown in FIG. 5 with the flame 510 back in the combustion chamber 515.

The exemplary embodiments described herein resolved redesign of a fuel nozzle that is susceptible to flame-holding. As such, nozzle designs are not constrained to designs that address flame-holding issues. The exemplary embodiments also eliminate the performance penalty associated with constant diluent flow. The exemplary embodiments described herein decrease impact to the design cost and performance, and simultaneously reduce risk of hardware damage, by allowing flash-back to occur, but then scheduling or triggering a pulse of inert gas flow to extinguish the flame in the hold point, forcing the flame to return to the combustion chamber before significant damage can occur.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. In a gas turbine having a combustor can and a fuel nozzle disposed in the combustor can, a flame-holding control method, comprising:

performing a first scheduled injection of a diluent stream into the nozzle;

setting a time threshold based on durability of the fuel nozzle subject to a flame-holding event;

checking to see if a time period has exceeded the time threshold; and in response to the time period being greater than the time threshold, performing a second scheduled injection of the diluent stream into the nozzle, wherein the first and second scheduled injections are pulsed injections performed for a pulsed time period less than the time threshold, and injected at an amount above a diluent threshold for quenching the flame-holding event.

2. The method as claimed in claim 1 further comprising checking for a flame-holding event in the nozzle.

3. The method as claimed in claim 2 further comprising in response to a detection of the flame-holding event in the nozzle, performing a triggered injection of the diluent stream into the nozzle.

4. The method as claimed in claim 3 further comprising generating a report of the flame-holding event.

5. The method as claimed in claim 3 further comprising delaying scheduled injections of the diluent stream if no flame is detected within the nozzle.

6. The method as claimed in claim 5 further comprising commencing the scheduled injections of the diluent stream after the triggered injection of the diluent stream as needed based on detection of a flame.

7. The method as claimed in claim 6 further comprising determining if operation of the gas turbine is to continue.

8. The method as claimed in claim 1 further comprising initializing the time period to zero concurrent with the first scheduled injection of the diluent stream.

9. The method as claimed in claim 8 further comprising performing an additional scheduled injection of the diluent stream into the nozzle each time the time period has exceed the time threshold.

10. The method as claimed in claim 9 further comprising resetting the time period to zero after each of the first scheduled injection, the second scheduled injection and the additional scheduled injection of the diluent stream.

11. A gas turbine system, comprising:

a compressor configured to compress air;

a combustor can in flow communication with the compressor, combustor can being configured to receive compressed air from the compressor and to combust a fuel stream;

a fuel nozzle disposed in the combustor can and configured to receive scheduled injections of a diluent stream and a triggered injection of the diluent stream to the fuel nozzle; and a timer configured to generate timed periods after which the scheduled injection is performed, wherein the scheduled injections are pulsed injections performed for a pulsed time period less than a predetermined time threshold, wherein said time threshold is based on nozzle's ability to withstand a flame holding event with no detriment, and injected at an amount above a diluent threshold for quenching the flame-holding event.

12. The system as claimed in claim 11 further comprising a diluent stream source configured to perform a scheduled injection of a diluent stream and a triggered injection of the diluent stream to the fuel nozzle.

13. The system as claimed in claim 11 wherein the fuel nozzle is configured to receive the compressed air in the combustor can mixed periodically with the diluent stream from the scheduled injection.

14. The system as claimed in claim 11 further comprising a series of detectors disposed on the fuel nozzle and configured to detect heat changes in the fuel nozzle.

15. The system as claimed in claim 14 wherein the fuel nozzle receives the triggered injection in response to the detectors sensing a heat change indicative of a flame-holding event in the fuel nozzle.

16. A flame-holding control system, comprising:

a gas turbine combustor can;

a fuel nozzle disposed in the combustor can and configured to receive compressed air and a fuel stream to generate a flame, and further configured to receive scheduled injections of a diluent stream to prevent a flame-holding event and a triggered diluent stream to inhibit combustion in response to a detection of a flame-holding event; and a timer configured to generate timed periods after which the scheduled injection is performed, wherein the scheduled injections are pulsed injections performed for a pulsed time period less than a predetermined time threshold, wherein said time threshold is based on nozzle's ability to withstand a flame holding event with no detriment, and injected at an amount above a diluent threshold for quenching the flame-holding event.

17. The system as claimed in claim 16 further comprising a diluent stream source coupled to the fuel nozzle.

18. The system as claimed in claim 17 wherein the fuel nozzle is configured to receive the compressed air in the combustor can mixed periodically with the diluent stream from the scheduled injection.

19. The system as claimed in claim 18 further comprising a series of detectors disposed on the fuel nozzle and configured to detect heat changes in the fuel nozzle.

20. The system as claimed in claim 19 wherein the fuel nozzle receives the triggered injection in response to the detectors sensing a heat change indicative of the flame-holding event in the fuel nozzle.

* * * * *